United States Patent [19]

Bellinger

[11] 4,340,165

[45] Jul. 20, 1982

[54] PRINTER ARM

[75] Inventor: James E. Bellinger, Melbourne, Fla.

[73] Assignee: Florida Data Corporation, Melbourne, Fla.

[21] Appl. No.: 145,062

[22] Filed: Apr. 28, 1980

Related U.S. Application Data

[60] Division of Ser. No. 29,658, Apr. 13, 1979, Pat. No. 4,248,540, which is a continuation of Ser. No. 621,526, Oct. 10, 1975, abandoned, which is a division of Ser. No. 865,006, Dec. 27, 1977, Pat. No. 4,206,266.

[51] Int. Cl.[3] ..... B23K 33/00; B23P 15/00

[52] U.S. Cl. ..... 228/173 C; 29/463; 228/173 F

[58] Field of Search ..... 228/173 C, 173 F, 173 R; 29/509, 463; 428/577, 578, 582, 583, 596; 400/124; 101/93.05; 346/139 C; 401/88, 95

[56] References Cited

U.S. PATENT DOCUMENTS

| | | | |
|---|---|---|---|
| 389,180 | 9/1888 | Wiggins | 29/463 |
| 1,280,606 | 10/1918 | Whitney | 228/173 R |
| 1,669,706 | 5/1928 | Hamilton | 228/173 X |
| 2,484,398 | 10/1949 | Bell et al. | 29/509 |
| 3,150,440 | 9/1964 | Jahn | 29/509 X |
| 3,163,491 | 12/1964 | Daigler | 346/139 C |
| 4,136,978 | 1/1979 | Bellinger, Jr. et al. | 101/93.05 X |

*Primary Examiner*—Gus T. Hampilos
*Attorney, Agent, or Firm*—Howard L. Rose

[57] ABSTRACT

An arm for holding the impact stylus of a high speed dot matrix printer is fabricated from a single stamping which when properly folded defines two members having C-shaped cross-sections joined by a thin web. The web is folded around the stylus to bring the 4 legs of the two C-shaped members into overlapping relationship to define a hollow elongated and tapered arm having the stylus substantially wholey encircled by the web whereby after brazing the stylus is securely held.

4 Claims, 6 Drawing Figures

PRINTER ARM

This is a division of application Ser. No. 029,658, filed Apr. 13, 1979, now U.S. Pat. No. 4,248,540, which is a continuation of Ser. No. 621,526, Oct. 10, 1975, which is a division of application Ser. No. 865,006, filed Dec. 27, 1977, now U.S. Pat. No. 4,206,266.

CROSS REFERENCE TO RELATED APPLICATIONS

The present invention is related to copending U.S. patent application Ser. No. 850,848 filed Nov. 11, 1977, in the names of James E. Bellinger and John H. MacNeill now U.S. Pat. No. 4,136,978, which was a continuation of U.S. patent application Ser. No. 621,526, filed Oct. 10, 1975 (now abandoned) in the names of James E. Bellinger and John H. MacNeill for High Speed Electromagnetic Printing Head, and assigned to the same assignee as the present application.

BACKGROUND OF THE INVENTION

The present invention relates to high speed dot matrix impact printers and more specifically to the structure of an arm which carries at one end a stylus at substantially right angles to the arm which stylus impacts a record material through an inked ribbon to apply a dot to the material.

In said U.S. Pat. No. 4,136,978, there is disclosed a dot matrix printer operating at speeds of 600 characters per second and higher. Each character is formed in accordance with a prescribed matrix such as 5×7, such a matrix requiring 7 stylii disposed in a vertical column. Each stylus is provided with an individual driver mechanism comprising a magnetic circuit for holding an arm in a cocked position against a spring force and releasing the arm upon command to permit the spring to move the arm rapidly in a printing direction. The arm carries a printing stylus at one end; the stylus being generally perpendicular to the arm. Impact of the stylus against the recording material and underlying platten causes a rebound which aids the recapture of the arm by the magnetic circuit.

It is believed apparent that the arm and the stylus must be of quite light weight and thus of thin material to permit the high speeds of operation achieved by the aforesaid device. The strain on the bond between the stylus and the arm is severe considering the thinness of the material and the limited bonding area of the construction of the arm in the aforesaid device.

It is an object of the present invention to provide an arm for dot matrix impact printers which permits a printer stylus to be securely held at the end of the arm and which provides thickened top and bottom portions of said arm for optimum strength-to-weight ratio.

It is another object of the present invention to provide an arm for dot matrix impact printers constructed from a single stamping or other appropriately formed blank which when folded provides two C-shaped members joined by a web adapted to encircle substantially half a stylus whereby to provide a large surface of contact therebetween and permit a secure bonding by brazing or otherwise.

SUMMARY OF THE INVENTION

The present invention provides an elongated arm for holding and actuating a stylus of a dot matrix impact printer formed from a blank generally symetrical about a centerline perpendicular to the elongated dimension of the blank. Each half of the blank has a central elongated rectangular region and triangular members along both elongated edges. The rectangular regions are joined by a web of material to complete the blank.

One of the rectangular members is wider than the other by approximately twice the thickness of the metal from which the blank is formed. The triangular members taper from a minimum width at the joined ends of the two rectangular members to a maximum width adjacent the unconnected ends of the rectangular members.

The arm is formed by folding the triangular members at right angles to the rectangular members to provide two squared, C-shaped members with the cross section of the "C" diminishing as the web is approached. The two C-shaped members are rotated into facing relationships, with the triangular sections overlapping, by bending the web about a mandrel. The two members are then secured as by brazing adjacent triangular sections to form a hollow rectangular box of decreasing width and double thickness top and bottom walls for added strength. The stylus is completed bounded by the web and overlapping triangular sections and when brazed, spot welded, etc. to the arm is securely held thereby over a large surface area.

BRIEF DESCRIPTION OF THE DRAWINGS

The above and still further objects, features and advantages of the present invention will become apparent upon consideration of the following detailed description of several specific embodiments thereof, especially when taken in conjunction with the accompanying drawings, wherein.

DESCRIPTION OF THE PREFERRED EMBODIMENTS

Figure 1:
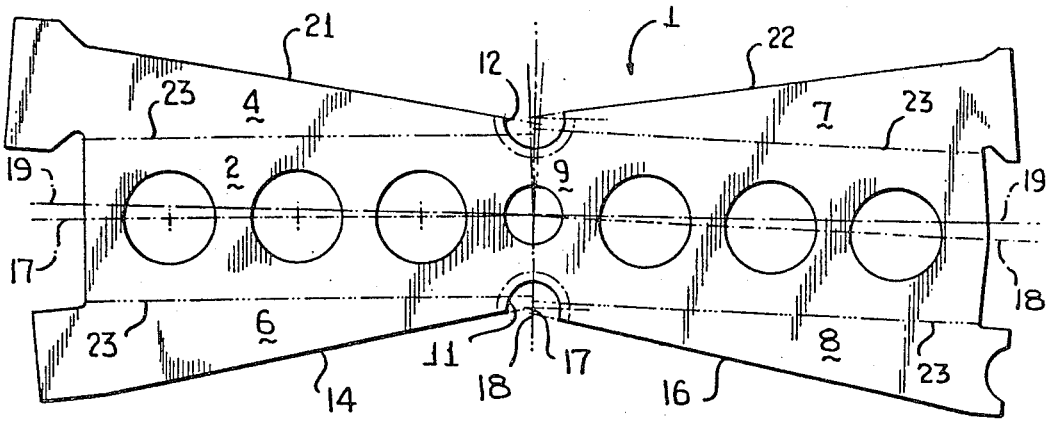
FIG. 1 is a top view of the blank from which the arm of the present invention is formed.

Referring specifically to FIG. 1 of the accompanying drawings, there is illustrated a blank, generally designated by the reference numeral 1, from which the arm of the present invention may be formed. The blank includes two rectangular sections 2 and 3, each bounded along both of its elongated edges by triangular sections 4 and 6 and 7 and 8, respectively. The rectangular sections 2 and 3 are joined by a web of material 9.

Since it is intended that when the arm is fully formed the triangular members overlap one another, the rectangular section 3 is wider (vertical dimension in FIG. 1) than section 2 by about twice the thickness of the material from which the blank is formed. Thus, the triangular sections 4 and 6 of section 2 may fit within the triangular sections 7 and 8 of section 3. Arcuate recesses 11 and 12, are semicircles having centers lying along vertical centerline 13 of the blank as viewed in FIG. 1. The centers of recesses 11 and 12 are located halfway between the intersection of extensions of the outer edges of the triangular sections with the centerline 13.

Specifically, for example, edges 14 and 16 of triangular sections 6 and 8, respectively, intersect centerline 13 at 17 and 18, and the center of arc 11 is located halfway between them. The same arrangement applies with respect to arc 12.

The arcuate recesses 11 and 12 are formed to provide the triangular members 4, 6, 7 and 8 with curved ends that engage, in the assembled arm, the side of the stylus remote from the web 9. Thus, the stylus is engaged by the web over approximately 180° of its surface and the end surfaces of the triangular members over the opposed 180° surface at the top and bottom of the stylus.

A second deviation from complete symmetry of the blank results from the arrangement of arms in the printer. The spacing between stylii must, to form a proper dot matrix character, be less than the spacing between stylii permitted by the width of the arms along such column of stylii. In order to align the stylii, the arms are alternately offset to either side of the desired centerline of the stylii at the printing surface. The stylii are angled in slightly and guided to near perfect alignment by a guide block.

The second deviation from symmetry of the block provides the necessary angling of its associated stylus. Specifically, the centerline of each rectangular section, reference numerals 17 and 18, respectively, is angled down by 2.5° from a straight line 19 that passes through the center of and is perpendicular to the axis 13. This result is accomplished by forming the web 9 as a regular trapezoid with sides diverging at 2.5° from the centerline 13, for a total divergence at the intersection of the arc 12 and the upper edges 21 and 22 of triangular sections 4 and 7, respectively, of 5°. The angular values given herein are for a particular configuration of printer and are not intended to be limiting; the angles are of necessity tailored to specific structures.

Figure 2:
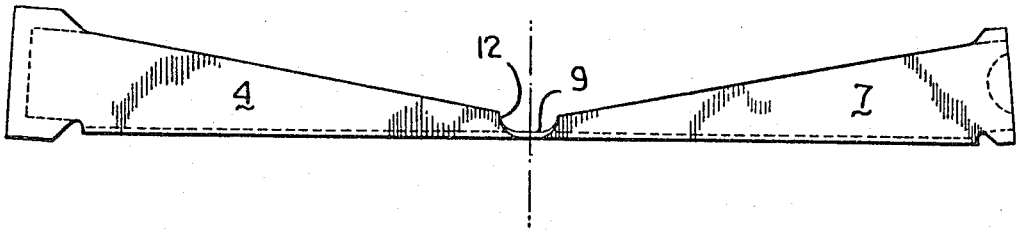
FIG. 2 is a top view of the blank after the triangular members have been folded at right angles to the rectangular members.
Figure 3:
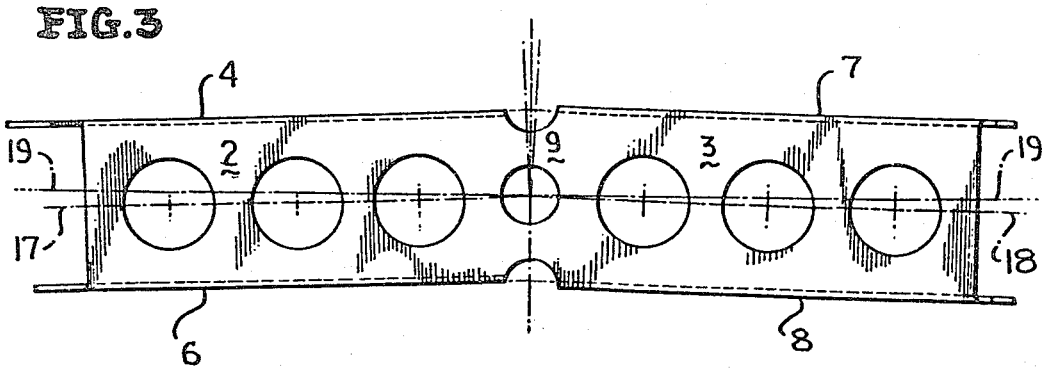
FIG. 3 is a side view in elevation of the structure of FIG. 2.

Each linear intersection of triangular and rectangular sections is defined by a fold line 23. Referring now specifically to FIGS. 2 and 3, triangular sections 4, 6, 7 and 8 have been folded along fold lines 23 so as to be positioned at right angles to rectangular sections 2 and 3 whereby to define two C-shaped members. The top members 4 and 7 of the "C", as viewed in FIG. 2, taper down as they approach the web 9 and it will be readily noted in FIG. 3 that the bottom and top surfaces of the folded structure slope downward due to the 5° divergence of the web 9. Also, it is apparent from FIG. 3 that the distance between the bottom and top surfaces of the left member are equal to the distance between the inner surfaces of triangular members 7 and 8.

Figure 4:
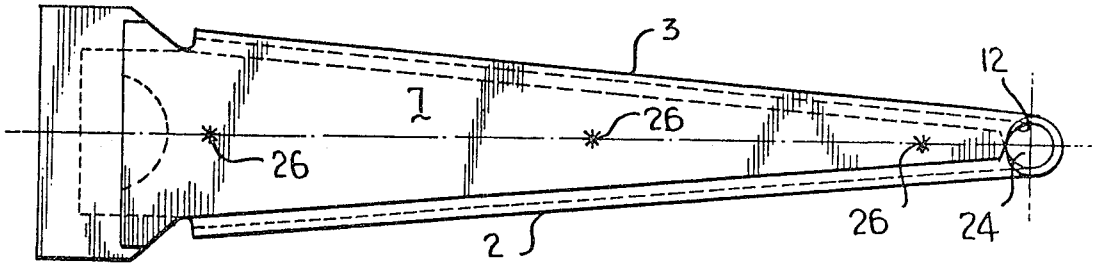
FIG. 4 is a top view of the assembled arm.
Figure 6:
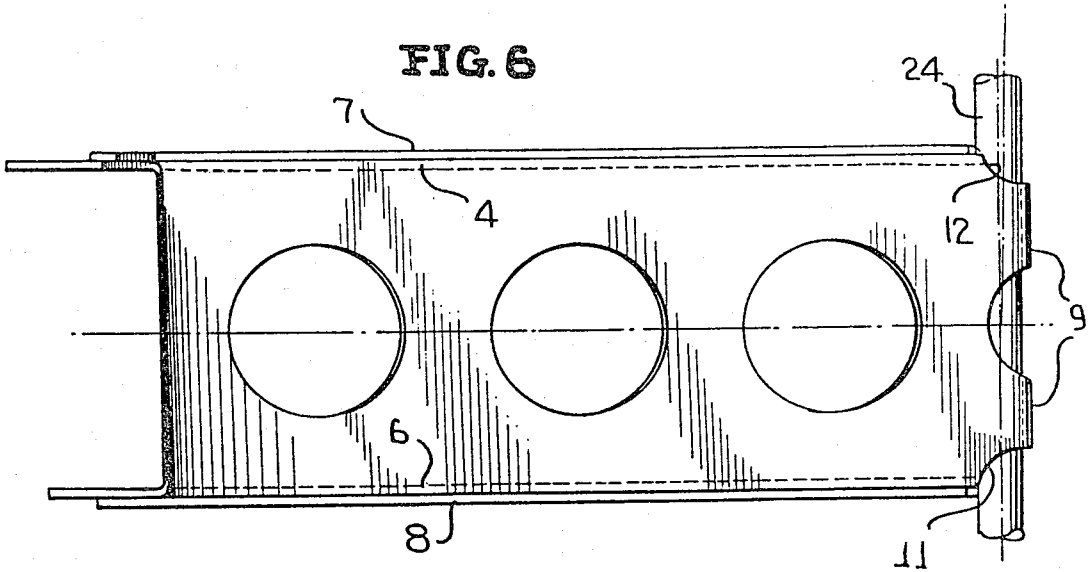
FIG. 6 is a side view in elevation of the fully assembled arm.
Figure 5:
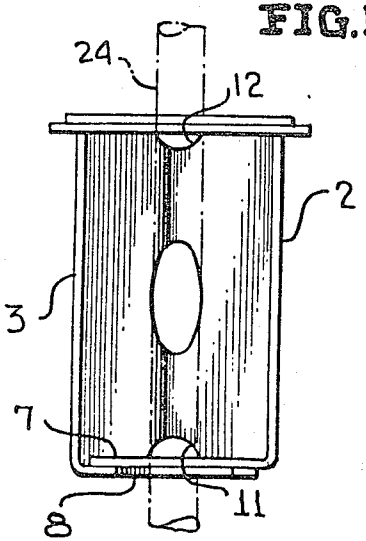
FIG. 5 is an end view of the assembled arm.

Referring now specifically to FIGS. 4, 5 and 6 of the accompanying drawings, the completed arm is illustrated. To form the structure of FIGS. 4, 5 and 6, the left and right halves of the device of FIGS. 2 and 3 are folded about a mandrel 24 so that the triangular members 4 and 6 lie inside of members 7 and 8 and each pair may be spot welded to one another as indicated by reference numerals 26, or otherwise appropriately secured. As pointed out in the aforesaid copending application the double thickness of the top and bottom walls of the arm is essentially to prevent undue whipping, twisting and bending of the arm; the requirement for such double thickness being provided inherently by the fabrication of the arm from a single blank.

After forming as above, it is noted that the web 9 substantially completely encircles one half of the mandrel 24 while the arcuate ends of the triangular sections 4, 6, 7 and 8 engage the opposed 180° surface of the mandrel 24 at the top and bottom thereof. The arcuate recesses 11 and 12 not only provide additional support for the stylus but also serve to positively locate the stylus in the arm. After removal of the mandrel a stylus may be inserted; the dimensioning being such as to provide a light push-fit for the size stylus rod to be employed. Thereafter the stylus is appropriately secured, as by brazing, spot welding, etc. to the arm to provide a very strong well supported bond between arm and stylus.

The triangular members 4, 6, 7 and 8 carry on their ends remote from the web various tabs employed to connect the arms to adjacent members of the printer head. The tabs form no part of the present invention and are not discussed herein. The various holes in the blank are provided to reduce the weight of the arm.

The blank 1 may be fabricated from various light and strong materials, for instance 17-7 PH stainless steel; one of many acceptable, like materials.

While I have described and illustrated specific embodiments of our invention, it will be clear that variations of the details of construction which are specifically illustrated and described may be resorted to without department from the true spirit and scope of the invention as defined in the appended claims.

I claim:

1. The method of fabricating an arm and stylus structure comprising the steps of providing a flat, thin blank for forming the arm having two generally rectangular regions with short and long dimensions and an integral web portion positioned therebetween and having short and long dimensions, said web region having its long dimensions each juxtaposed to a short dimension of a different one of said rectangular sections, said blank also including four generally triangular regions each of which is integrally associated with a different long dimension of said rectangular regions, said triangular regions each tapering from a maximum outward extension from an adjacent rectangular region remote from said web portion to a minimum extension adjacent said web portion; bending said four triangular regions along said rectangular region long dimensions to position said triangular regions at right angles to said rectangular regions with all of said triangular regions extending normal to one side of said rectangular regions; bending said blank about a stylus such that the web forms a generally semicylindrical member having a longitudinal axis generally parallel to said long dimension of said web, said web substantially circling at least one-half of the stylus such that opposed pairs of said triangular regions are in overlapping relationship to one another; bonding said overlapping triangular regions one to the other; and, securing said stylus to said web.

2. The method according to claim 1 wherein the triangular regions at their minimum extension terminate in concave arcuate surfaces, the further step of said method comprising bending said blank about the stylus until the concave arcuate surfaces engage the stylus.

3. The method according to claim 1 or claim 2 wherein bending of the triangular region is such that both regions of one rectangular region fit within the bent regions of the other rectangular region.

4. The method according to claim 1 or claim 2 wherein bending of said blank about said stylus is along an axis lying at an angle of greater than 90° to the axis of the long dimension of the rectangular region.

* * * * *